United States Patent [19]

Hogrefe

[11] Patent Number: 4,932,227

[45] Date of Patent: Jun. 12, 1990

[54] APPARATUS AND METHOD FOR AUTOMATICALLY INJECTING LAUNDRY TREATING CHEMICALS INTO A COMMERCIAL WASHING MACHINE

[75] Inventor: James T. Hogrefe, Saddle Brook, N.J.

[73] Assignee: Lever Brothers Company, New York, N.Y.

[21] Appl. No.: 247,196

[22] Filed: Sep. 21, 1988

[51] Int. Cl.[5] ..... D06F 33/02

[52] U.S. Cl. ..... 68/17 R; 68/207; 68/12 R; 134/57 D; 222/59; 222/651

[58] Field of Search ..... 68/17 R, 207, 12 R; 134/57 D; 222/1, 59, 651

[56] References Cited

U.S. PATENT DOCUMENTS

| | | | |
|---|---|---|---|
| 3,094,247 | 6/1963 | Marchi | 68/17 R X |
| 3,160,317 | 12/1964 | Hambro | 68/17 R |
| 3,680,784 | 8/1972 | Fakes | 134/57 D |
| 3,804,297 | 4/1974 | Jurjans | 58/17 R X |
| 3,834,364 | 5/1958 | Federighi et al. | 137/88 |
| 3,881,328 | 5/1975 | Kleimola et al. | 68/12 R |
| 3,982,666 | 9/1976 | Kleimola et al. | 222/70 |
| 4,103,520 | 8/1978 | Jarvis et al. | 68/12 R |
| 4,335,591 | 6/1981 | Gillespie | 68/12 R |
| 4,362,033 | 12/1982 | Young | 68/207 |
| 4,503,575 | 3/1985 | Knoop et al. | 68/207 |

*Primary Examiner*—Frankie L. Stinson
*Attorney, Agent, or Firm*—Milton L. Honig

[57] ABSTRACT

An apparatus for cleaning fabrics includes a washing machine having a housing, a wash chamber, hot and cold water inlet conduits in the housing leading to the chamber, and at least one laundry chemical inlet conduit. Water flow sensing means are placed in the hot and cold water lines, respectively, located outside of the housing. The flow of water generates a signal in the sensing means which then sends an electronic impulse to a control head having a program that stores and selectively activates a plurality of pumps. These pumps deliver laundry chemicals from supply containers into the wash chamber of the machine.

7 Claims, 2 Drawing Sheets

APPARATUS AND METHOD FOR AUTOMATICALLY INJECTING LAUNDRY TREATING CHEMICALS INTO A COMMERCIAL WASHING MACHINE

BACKGROUND OF THE INVENTION

1. Field of the Invention

The invention is directed at a system which senses the washing cycle steps of an automatic laundry washing machine and signals the controlled flow of one or more cleaning chemicals into the machine washing chamber.

2. The Prior Art

Most commercial laundry washing machines have a liquid chemical feed dispenser which injects fabric treating chemicals into the washer. Among such chemicals are alkali, detergent, bleach, souring agent and fabric softener. More than 90% of these dispensers are interfaced electrically with the internal controller of the washing machine.

There are two types of controls used in washing machines: one is called a non-programmable, and the other a programmable type. The non-programmable control has fixed wash formulas, set up by the machine manufacturer, which cannot be altered. Switching contacts ride on cams encased in the programmer that operates the various functions of the washer.

Programmable models are run by a chart or card which the installer of the chemical dispenser cuts to create a wash formula. Each cut in the chart or card causes a microswitch to open or close creating operation of a function of a wash formula.

A electrical signal from inside the washing machine internal controls, i.e. the program, is normally required to activate injection of a cleaning chemical. On most older washers and even some of the newer ones, locating and tying into these control circuits is not always easy. Also, once an installer has gone into the controls, there is a great risk that those internal controls are damaged or otherwise adversely affected.

Where an installer is not a representative of the washing machine manufacturer, there is also the further problem of voiding factory warranties. Manufacturers do not want unauthorized technicians tampering with the internal controls of their machine.

There have been a number of patents issued focusing upon the problem of delivering cleaning chemicals to the washer. U.S. Pat. No. 4,335,591 (Gillespie) reports use of separate sequence controllers connected to a line of multiple washers. Each of the controllers intercommunicates with every other one and operates a series of electromagnetic valves to deliver detergent and bleach based upon electronic energizing signals.

U.S. Pat. No. 3,982,666 and U.S. Pat. No. 3,881,328, both to Kleimola et al., disclose a detergent dispensing system for sequentially and automatically injecting detergents, fabric conditioners and other cleaning chemicals into a laundry washing machine. A signaling device synchronized with the washing machine cycle selectively actuates and deactuates solenoid-operated valves positioned upstream of Venturi-Aspirators assigned to each chemical line. Predetermined quantities of each liquid chemical can thereby be delivered at any desired point in the machine cycle.

Another automated laundry system is reported in U.S. Pat. No. 4,103,520 (Jarvis et al.). Here an injector having a plurality of liquid additive reservoirs and associated timed control valves selectively can inject liquid additives into the washer. An adaptor connected to both the washer and injector controls sequencing throughout the operating cycle of the washer. This adaptor establishes sequential program signals to the injector where the washer does not have a built-in programer.

Automatic dishwashing machines as described in U.S. Pat. No. 2,834,364 (Federighi et al ) have also been fitted with sensors to activate addition of cleaning chemicals. The patent describes a hot water feed pipe to which is connected a pressure switch When there is a drop in water pressure, the switch causes an electric valve to open which allows a quantity of liquid soap or detergent to flow into the washing tank.

Common to the aforementioned art is the requirement for invading the machine housing to connect into the programer controlling the dispenser system. Thus, there arises the problem of installation difficulty, equipment compatibility and, ultimately, voiding of machine warranties.

Accordingly, it is an object of the present invention to provide a system for dispensing laundry treating chemicals to an automatic washing machine without requiring the dispenser installer to invade the machine housing.

Another object of the present invention is to provide a system for dispensing laundry treating chemicals into ar automatic washing machine that is very simple to install and operate.

Another object of the present invention is to provide a system for delivering detergent, fabric softener, alkali, bleach and/or souring agent to an automatic washing machine for the laundering of fabrics.

Another object of the present invention is to provide a system for dispensing laundry treating chemicals into ar automatic washing machine which does not result in voiding machine manufacturer warranties.

Another object of the present invention is to provide a system for the delivery of laundry treating chemicals tc an automatic washing machine which is not limited by a washing sequence formula pre-programmed into the machine itself.

Still a further object of the present invention is to provide an apparatus for dispensing laundry treating chemicals into an automatic washing machine that operates to accomplish the objects as aforedescribed.

SUMMARY OF THE INVENTION

An apparatus for washing fabrics is provided including:

a washing device having:

a housing;

a wash chamber in said housing;

a hot and a cold water inlet conduit in said housing communicating with said chamber;

at least one laundry treating chemical inlet conduit in said housing communicating with said chamber; and optionally, a wash program selector in said housing;

a hot water line outside said housing connecting a source of hot water to said hot water inlet conduit;

a cold water line outside said housing connecting a source of cold water to said cold water inlet conduit;

at least two sensing means for sensing a flow of water and converting a flow signal therefrom into an electronic impulse, a first of said means connected to and sensing a flow in said hot water line and a second of said means connected to and sensing a flow in said cold water line;

a plurality of pumps;

a control head receiving and storing said electronic impulses and comprising a program to selectively activate said plurality of pumps;

a plurality of laundry treating chemical supply, containers, one of said containers holding a detergent;

at least one conduit connecting said supply containers to said at least one laundry treating chemical inlet conduit, said pumps activating transfer of detergent through said connecting conduit; and optionally, a means for communicating between said wash program selector and said control head.

BRIEF DESCRIPTION OF THE DRAWING

Various features and advantages of the present invention will more readily be apparent through the following description in conjunction with the accompanying drawings of which.

DETAILED DESCRIPTION OF THE INVENTION

Figure 2:
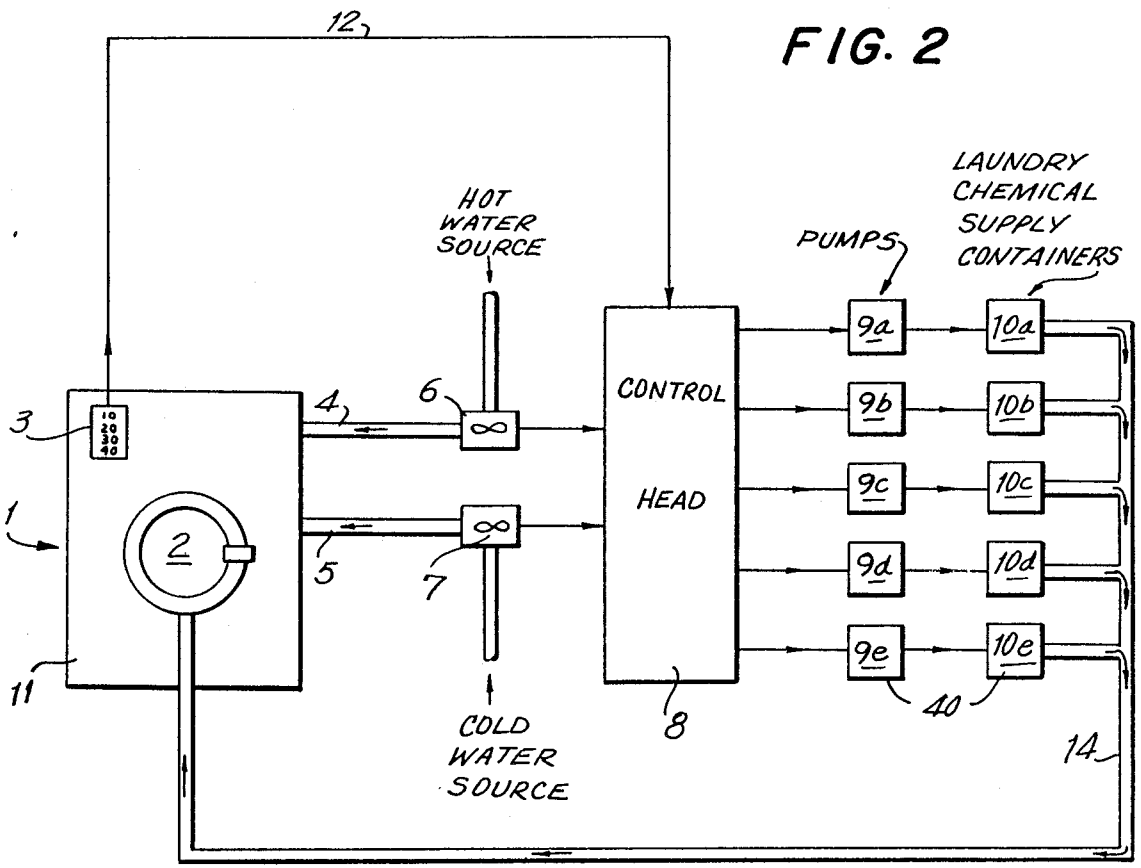
FIG. 2 is a broad schematic view of the electrical and fluid connections interconnecting the machine and dispenser system.
Figure 1:
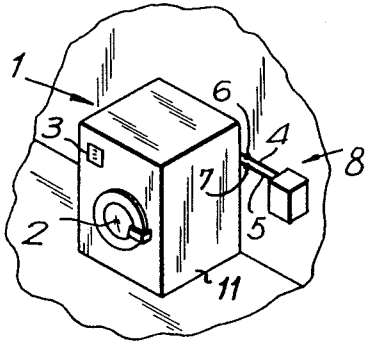
FIG. 1 is a diagrammatic plan view of the overall machine and dispenser system.

By reference to FIG. 1, the system is seen to include a washing machine (1) with wash chamber (2), hot and cold water (4,5) lines leading into the washer, water flow sensors (6,7) in each of the water lines, a control head (8), a series of pumps (9) and a series of laundry treating chemical supply containers (10). Each of these features will now be discussed in more detail.

Focus of this invention is to allow a chemical supplier representative to install the chemical dispensers (10) and their external control head (8) without connecting to electrical wiring of control timers inside the washing machine housing (11). Therefore, a critical aspect of the invention is placement of a water flow sensor (6, 7) within the water lines (4,5) leading into the washing machine housing. These sensors will be activated by the flow of water to set-off a mechanical or electrical switch, which in turn will send an electronic impulse tc the control head (8). Whenever there is any flow of water, the sensor will continuously emit the electronic impulse over the &time period of flow. Once the water flow has ceased the emitted electronic impulse will also cease.

A typical laundry wash sequence will include cycles where either hot or cold water will be required exclusively. For instance, the main wash step using detergent will normally involve a hot or warm water fill. On the other hand, a subsequent rinse cycle will normally exclusively utilize cold water. Therefore, it is necessary to monitor both the hot and the cold water lines separately to determine the stage of the washing sequence. It should be noted that not every water flow induced electronic impulse results in the triggering of a chemical delivery. Cycles such as certain of the rinses do not include injected chemicals. However, the electronic impulse must be registered by the control head to keep count and accurately track the washing sequence.

Flow sensors may be placed either directly in the water line or adjacent thereto. For instance, a butterfly rotating valve may be used within the water line. Alternatively, a non-invasive sensor may consist of a photo cell positioned around the outside of a transparent segment of the water delivering conduit. There may also be a combination of mechanical valve within the water line signaling a magnetic pick-up device surrounding the outside of the water conduit.

Within the context of the present invention, the term "hot" water refers to a temperature in the range of from about 100° F. to about 180° F., most preferably from about 120° F. to 140° F. Likewise, the term "cold" water encompasses a temperature range from about 40° F. to about 80° F., preferably between about 50° F. and 70° F.

Another highly important component of the present system is a control head (8). Within the control head is a stepping switch (22), dip switches (32), a reversing relay (50), pump relay (40), and programming relays (60).

Figure 3:
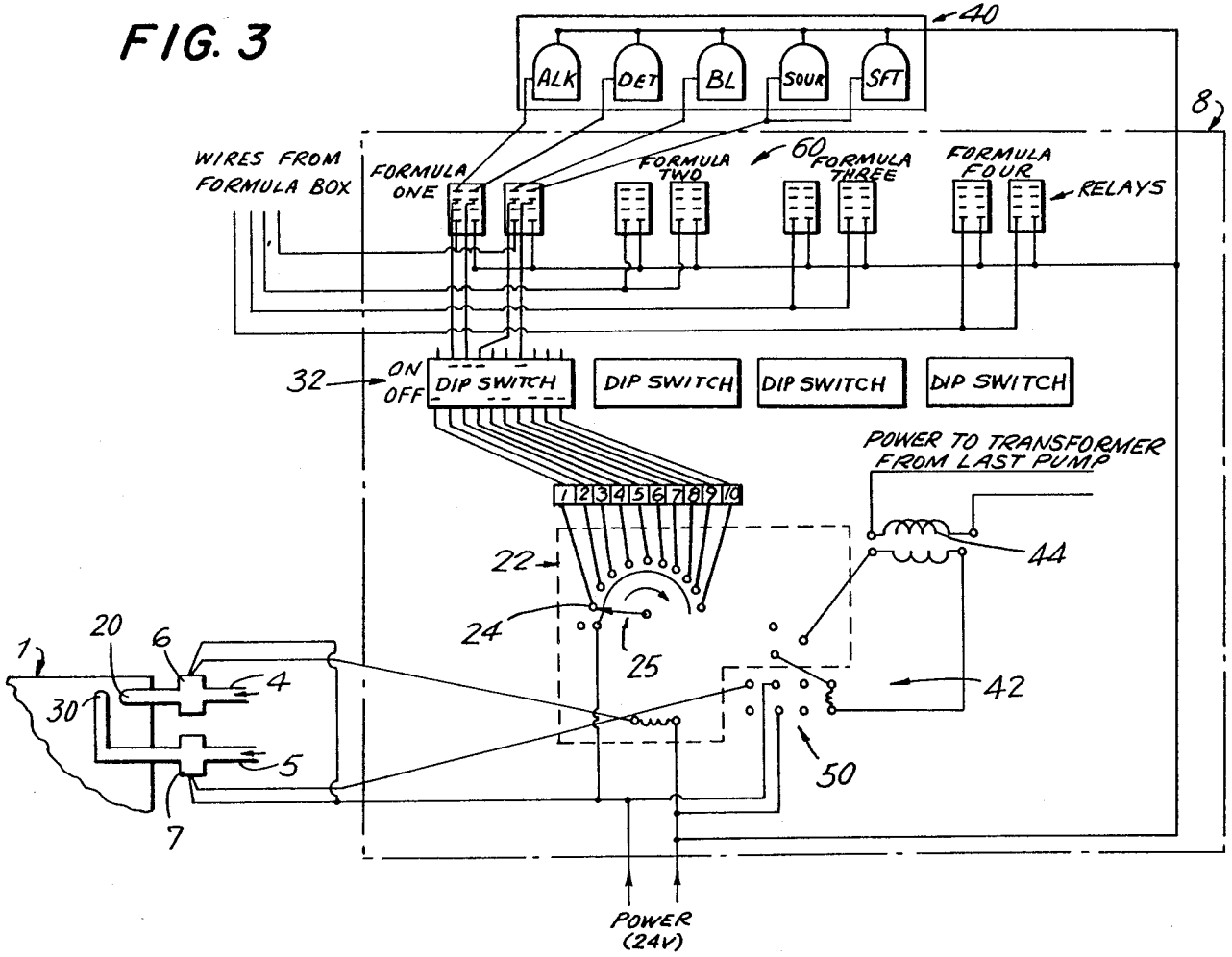
FIG. 3 is a schematic view of the system with a more detailed illustration of the electrical wiring, switches and logic circuits.

Stepping switch (22) comprises a series of terminals (24) (shown in FIG. 3 as being 10 in number). Switch member (25) is movable from one terminal to the next in a semi-circular fashion step-wise, each step being actuated by a change in electronic impulse.

From the stepping switch terminal, the electronic impulse is transferred to one of a group of dip switches (32) which may either be in the "on" or "off" position dependent upon the particular wash program desired. Where a dip switch (32) is in the "on" position, the signal will pass to delivery instructing programming relays (60). A further series of electrical connections transmit signals from the relays (60) to activate the respective pumps (9) which then deliver cleaning chemicals into the wash chamber (2) of machine (1).

Some washing machines are user programmable. The programs are set by a chart or card upon which a formula sequence is cut. Each cut in the card or chart causes a microswitch to open or close creating occurrence of a certain function in the wash sequence. These programs operated by a program selector (3) can be interfaced through an electrical connection (12) with the chemical formula relays (60) of control head (8).

Operation of the system is best explained as follows. The washing machine will operate in the same manner as is normally done, whether the machine is user programmable or non-programmable. When the washer is started for a particular wash formula, an operator will activate a switch on formula box (3) that corresponds to the classification of wash being done. This box is normally located outside of and normally on the front of a machine. When the switch on the formula selector (3) is "on", contacts of the relays (60) corresponding to the program formula will close.

When water enters the machine (hot, cold or both), contacts of one or both the water flow sensors (6,7) will send an electronic impulse to stepping switch coil (22) of the control head (8). Stepping switch (22) through its switch member (25) will contact terminals (24) in sequence. Thereby will be electrically energized a wire leading from the terminal to a respective dip switch (32). Those dip switches in the "on" position will then further send a signal to the programming relays (60) which trigger pumps that dispense the appropriate cleaning chemical from supply containers (10). This sequence will be repeated every time water enters to fill the washer. Each time the stepping switch coil receives a new electronic impulse, the next terminal, running from (1) to (10), will energize.

An installer of the dispenser system will set the on/off functions of dip switches (32) to correspond t the formulas being used by the formula box. The "on" positions of the dip switch will allow voltage to pass through that switch to the common C terminal of the relay. This then allows the electronic impulse to go from the normally open (N.O.) contact of the relay, which is now in the closed position, that was closed when the formula switch on the formula box was turned on. The electronic impulse will then go from the normally open (N.O.) contact of the relay to the central pumping unit (40). Thereupon, the proper chemical feed pump will activate to inject a chemical into the washer.

When the last step of a wash formula is started, the feed pump for the last chemical will cause the stepping switch member (25) to return to the zero terminal position.

To start another wash formula, a transformer (44) is energized when the last pump turns on. Reset contacts in the stepping switch are closed, and the coil (42) of a reversing relay (50) are energized. Relay (50) will then switch back and forth from N.O. to N.C. moving the switch member (25) of the stepping switch (22) back to the zero position.

An external power source, not from the washing machine (1), should be used so the dispenser system can be powered from a standard outlet.

Advantageously, the control head should be able to program up to six formulas. A formula would be composed of a series of steps in an amount corresponding to a fill cycle of the wash chamber (2) with water. Typical formulas are illustrated below.

TABLE I

| Formulas | | |
|---|---|---|
| Light Cleaning Formula | Medium Cleaning Formula | Heavy Cleaning Formula |
| Detergent/Bleach | Water Flush | Water Flush |
| Rinse | Detergent | Water Flush |
| Rinse | Bleach | Alkali |
| Softener | Rinse | Detergent |
| | Rinse | Rinse |
| | Softener | Rinse |
| | | Softener/Sour |

Any number of typical laundry treating chemicals may be employed with the present system. Invariably, the wash cycle will include feeding of a detergent to the wash solution in the laundry filled wash chamber. Examples of useful detergents are anionic, nonionic, cationic, zwitterionic and amphoteric surfactants. Among the most useful anionic surfactants are soap, alkylbenzene sulfonates, alkyl ether sulfates and alkyl sulfates. Useful nonionic surfactants include alkoxylated derivatives of fatty acids and fatty alcohols.

Normally, the last chemical to be added to a wash sequence is that of a fabric softener which normally is a quaternary ammonium compound. Typical of this class ar ditallow dimethyl ammonium methosulfate or chloride salts.

Other performance chemicals may be added and these can include alkali such as sodium carbonate, sodium hydroxide and sodium silicate. Bleach may also be included in one or more of the cycles. Normally, the bleach will be sodium hypochlorite but peroxygen bleaches may also be utilized when necessary. Souring agents, fluorescent brighteners, anti-redeposition agents, perfumes, enzymes and other fabric treating chemicals may be injected into the wash liquor. All of the aforementioned chemicals can either be delivered separately in separate cycles or can be delivered separately within a single cycle. Alternatively, several of the aforementioned chemicals can be combined within a single liquid product to be dispensed from a single supply container.

It is to be understood that the invention in its broader aspect is not limited to the specific elements shown and described above. Rather, the invention includes within the scope of the accompanying claims any departures made from such elements which do not sacrifice its chief advantages.

What is claimed is:

1. An apparatus for washing fabrics in a washing sequence, the apparatus comprising:
   - a washing device having:
   - a housing;
   - a wash chamber in said housing;
   - a hot and a cold inlet conduit in said housing communicating with said chamber; and
   - at least one laundry treating chemical inlet conduit in said housing communicating with said chamber; and
   - a hot water line outside said housing connecting a source of hot water to said hot water inlet conduit;
   - a cold water line outside said housing connecting a source of cold water to said cold water inlet conduit;
   - at least two sensing means for sensing a flow of water and converting a flow signal therefrom into an electronic impulse to thereby sense each stage of the washing sequence, a first of said means connected to and sensing a flow in said hot water line and a second of said means connected to and sensing a flow in said cold water line;
   - a plurality of pumps;
   - a control head receiving and storing said electronic impulses and comprising a program to selectively activate said plurality of pumps;
   - a plurality of laundry treating chemical supply containers, one of said containers holding a detergent, said chemical supply containers being located outside said housing; and
   - at least one conduit connecting said supply containers to said at least one laundry treating chemical inlet conduit, said pumps activating transfer of detergent through said conduit.

2. An apparatus according to claim 1 further comprising a wash program selector in said housing and a means for communicating between said wash program selector and said control head.

3. An apparatus according to claim 1 wherein said sensing means continuously generates an electronic impulse over the period of time that there is any flow of water in the respective hot and cold water lines.

4. An apparatus according to claim 1 wherein said program has at least one step which upon receipt of an electronic impulse does not instruct any of said pumps to be activated and thereby does not cause dispensing of a laundry treating chemical into said wash chamber.

5. An apparatus according to claim 1 wherein one of said chemical supply containers holds a fabric softener and said fabric softener is delivered as the last chemical in a washing sequence.

6. An apparatus according to claim 1 wherein said supply containers hold one or more chemicals selected from the group consisting of fabric softeners, bleaches, souring agents, alkali, fluorescent whitening agents, anti-redeposition agents, perfumes and mixtures thereof.

7. A method for delivering laundry treating chemicals utilizing the washing device as claimed in claim 1 wherein the method comprises:

installing a sensing means for sensing a flow of hot water in a line connecting a source of hot water to the hot water inlet conduit of the washing device;

installing a sensing means for sensing a flow of cold water in a line connecting a source of cold water to the cold water inlet conduit of the washing device;

converting a water flow signal sensed by said sensing means into an electronic impulse;

sending said electronic impulse to a control head which receives and stores said impulse;

activating a program in said control head through said electronic impulse;

activating one or more pumps through said program; and delivering a detergent and other laundry treating chemicals from their supply containers to the wash chamber of the washing device by the action of the activated pump.

* * * * *